US006482111B1

(12) United States Patent
Jofferion

(10) Patent No.: US 6,482,111 B1
(45) Date of Patent: Nov. 19, 2002

(54) GOLF TEE FOR DRIVING RANGES

(76) Inventor: Ronald L. Jofferion, 3543 Monticello Blvd., Cleveland, OH (US) 44121

( * ) Notice: Subject to any disclaimer, the term of this patent is extended or adjusted under 35 U.S.C. 154(b) by 0 days.

(21) Appl. No.: 09/507,589

(22) Filed: Feb. 21, 2000

(51) Int. Cl.[7] ..... A63B 57/00
(52) U.S. Cl. ..... 473/386; 473/400
(58) Field of Search ..... 473/387–403, 473/386, 278; D21/717, 718; 434/195, 200; 273/156

(56) References Cited

U.S. PATENT DOCUMENTS

| | | | | |
|---|---|---|---|---|
| 1,173,792 A | | 2/1916 | Fuchs | |
| 1,255,140 A | | 2/1918 | David | |
| 1,692,233 A | * | 11/1928 | Van Patten | 473/390 |
| D78,530 S | | 5/1929 | McLeod | |
| 1,929,579 A | | 10/1933 | Garlando | |
| 1,942,672 A | | 1/1934 | Thompson | |
| 2,165,479 A | * | 7/1939 | Hallberg | 473/398 |
| 2,202,556 A | | 5/1940 | Jordan | |
| 3,375,009 A | * | 3/1968 | Stubbmann et al. | 273/156 |
| 3,516,664 A | | 6/1970 | Brennan | |
| 3,697,082 A | | 10/1972 | Di Laura et al. | |
| D279,121 S | | 6/1985 | Wampler | |
| 5,156,403 A | * | 10/1992 | Martino | 473/396 |
| 5,720,677 A | | 2/1998 | Rudduck | |
| 5,766,100 A | | 6/1998 | Dilmore | |
| 5,776,014 A | | 7/1998 | Gustine | |
| 5,967,909 A | | 10/1999 | Broadbridge | |

FOREIGN PATENT DOCUMENTS

| | | | |
|---|---|---|---|
| GB | 2218341 | * 11/1989 | 273/32.5 |

* cited by examiner

*Primary Examiner*—Steven Wong
(74) *Attorney, Agent, or Firm*—D. Peter Hochberg; Katherine R. Vieyra; Sean Mellino

(57) ABSTRACT

A golf tee system including a body section with an upper, free portion, the upper free portion having at least two bores of different depths for receiving golf tees to hold a golf ball at different heights above the ground, and/or a dished, flattened portion for holding a golf ball.

3 Claims, 5 Drawing Sheets

GOLF TEE FOR DRIVING RANGES

BACKGROUND OF THE INVENTION

1. Field of the Invention

This invention relates to golf tees, and in particular to golf tees for use on driving ranges.

2. Description of the Prior Art

Golf tees have been known in a variety of forms for many years. A typical golf tee has a generally cylindrical body which is pointed at one end for insertion into the ground, and having a truncated cone at its other end which is generally concave for holding a golf ball. Golfers tee golf balls at different heights depending on the preference of the golfer and to the club which the golfer is using. Golfers generally tee golf balls up higher for clubs having a lower slant (i.e. a driver) and lower for clubs having less of a slant (i.e. a No. 3 wood). Golfers who use tees for irons generally only raise the ball a small amount from the ground. Likewise, when golfers practice at a driving range, most would generally prefer the option of varying the height at which a ball would be teed, depending again on the club which is used and the preference of the golfer.

Many golf ranges have a very simple teeing system. There is a rubber mat on which the golfer stands. A hole is provided in the mat from which extends a generally thin flexible rubber or rubber-like tube upon which the ball is set. The tube is of one height, and the golfer must use that height when hitting golf balls from the tee.

There are various patents which can be used for varying the height of a golf tee, other than simply sticking the golf tee in the ground at various depths. U.S. Pat. No. 1,173,792 (Fuchs) has a rotatable wheel having radially extended tees of different heights which can be rotated about an axis parallel with the ground, and beneath a tee board from which the respective tees extend for varying the height at which a ball is teed. A block having an oblong irregular-shaped trough and a vertically slotted tee pivotally mounted in the trough and adapted to be wedgingly supported in variable different, vertical positions in the block for changing the height of the tee, is described in U.S. Pat. No. 1,255,140 (David). In U.S. Pat. No. 1,929,579 (Garlando), a notched bar is moveable between a pair of spring loaded balls in the vertical direction for varying the height of the tee. Referring to U.S. Pat. No. 1,942,672 (Thompson), a golf tee is provided with a sharpened lower edge for penetration into the earth. The tee portion is moveable with respect to the body portion to vary the height in which the ball can be positioned on the tee. Another rotatable body having radially extending tees with different lengths is disclosed in U.S. Pat. No. 2,202,556 (Jordan). Disclosed in U.S. Pat. No. 3,516,664 (Brennan) is a golf tee holder for use in man-made turf, where a number of openings are provided for receiving golf tee holders. There is only one hole for receiving golf tees, so there is no height variation.

A variable height golf tee is disclosed in U.S. Pat. No. 5,720,677 (Rudduck). U.S. Pat. No. 5,776,014 (Gustine) has threaded bolt and stop nuts for allowing the user to select various heights on which a golf ball can be set above the ground. In U.S. Pat. No. 5,766,100 (Dilmore), a golf tee for use with a mat at a driving range is shown. The patent discloses a vertical tube extending through a hole in the mat, and an insert rests in the hole. The insert can be moved. The insert has an opening for receiving a conventional golf tee. The tee can be adjusted in the vertical direction to change the location of the ball. Referring next to U.S. Pat. No. 5,967,909 (Broadbridge), a golf ball tee holder is disclosed for a driving range, having a mat through which the teeholder extends. The tee-holder has a flat base and an integral central upward tubular shank extending from it. The shank has a dished upper end with a slot. A golf tee can be inserted in the slot, and it may be raised or lowered according to the golfer's discretion.

All but one of the patents described above provide means for varying the height at which a golf ball can be teed up. In many instances they are at driving ranges. All of these disclosures are quite complex, and therefore expensive and uneconomical.

U.S. Pat. No. Des. 279,171 shows a golf tee base with tethered golf tees of different heights which can be positioned to hold a golf ball at different heights. It, too, is complex and relatively expensive.

U.S. Pat. No. Des. 78,530 shows a golf tee, but it does not appear to have a variable height adjustment. U.S. Pat. No. 3,697,082 (Di Laura et al.) discloses a foam golf tee which is configured to engage irregularities in the ground. However, there is no way to vary the height of a golf ball supported on the tee.

Thus, there is no simple and economical golf tees available for driving ranges which enable the easy use of a teeing system for varying the height at which a golfer ay support a golf ball on the ground. The present invention achieves this result.

SUMMARY OF THE INVENTION

An object of the present invention is to provide a golf tee system, particularly for se at driving ranges, for enabling a golfer to vary the height at which a golf ball may be teed above the ground.

Another object of the present invention is to provide a variable height golf tee system which is simple in construction and easy to fabricate.

It is still another object of the present invention to provide an economical and efficient golf tee system for varying the height at which a golfer may support a golf ball at a driving range, which is not subject to damage despite prolonged use.

It is still another object of the present invention to provide a golf tee system for varying the height at which a golfer may support a golf ball, which is simple in construction and compact.

It is yet another object of the present invention to provide a golf tee for use at a driving range for supporting a golf ball very close to the ground.

It is yet another object of the present invention to provide a golf tee for supporting a golf ball close to the ground which is simple in construction, economical to make and use, which can be used alternatively with the golf tee systems described above for varying the height at which a golfer may support a ball teed on a mat at a driving range.

Other objects will be apparent from the description described below and from the appended claims.

The foregoing and other objects are achieved according to a preferred embodiment of the invention. According to the preferred embodiment of the invention, a support material made of a rubber or rubber-like body, such as a cylinder, is supported on a base. Two or more holes of different depths are provided in the free end of the body, and into which golf tees can be releasable inserted. The depth of the hole determines the amount that the golf tee can be inserted into the body, and this varies the height of the tee above the ground, and therefore the position at which a golf ball would be supported on the tee. The holder and body are disposed on the ground, and a mat of the type typically used at golf driving ranges can be place over the device, the mat having a hole through which the body of the device extends. The golfer can insert an ordinary golf tee into a desired hole depending on the golfers preference and the club which the golfer is using and hit the ball off the tee with the golf club. The body can have a dished, concave portion for supporting a ball without a separate tee, and an alternate body having the dished, concave portion without the tee-receiving holes.

DESCRIPTION OF THE PREFERRED EMBODIMENTS

Figure 1:
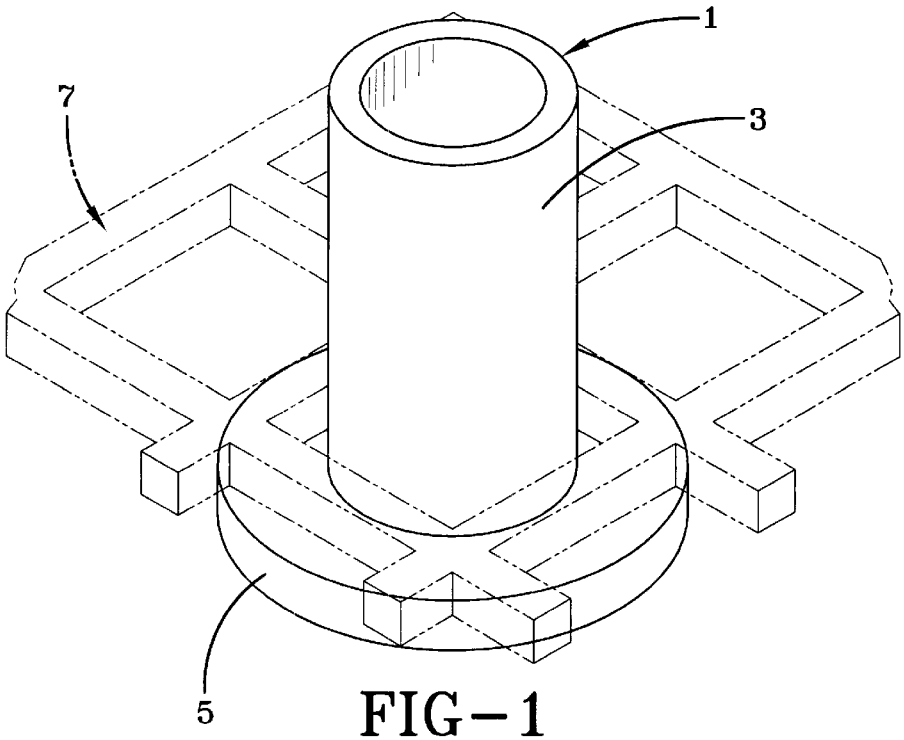
FIG-1 PRIOR ART
FIG. 1 is a perspective view of a golf tee holder for use in a driving range according to the prior art.

Referring to FIG. 1, a golf tee commonly used at driving ranges and according to the prior art is shown. The prior art thus includes a golf tee 1 which is composed of a relatively hard rubber or rubber-like tube 3 which is supported by a generally flat base 5 which can be made from the same material. The diameter of tube 3 is sufficient to hold a golf ball but is not deep enough for the golf ball to be supported very deep in tube 3.

The drawing is enlarged for clarity. A mat 7 is provided upon which the golfer stands.

Mat 7 has a square hole 9 which is large enough for tube 3 to extend through. Mat 7 is generally made from some type of slightly elastomeric material to simulate the grounds of a golf course.

When a golfer wants to hit a ball, the golfer simply puts the ball on top of tube 3, steps back and lines the club up with the ball and swings the club to hit the ball. The golfer cannot change the height of tube 3 regardless of the golfer's preference and regardless of the type of club the golfer is using.

Figure 2:
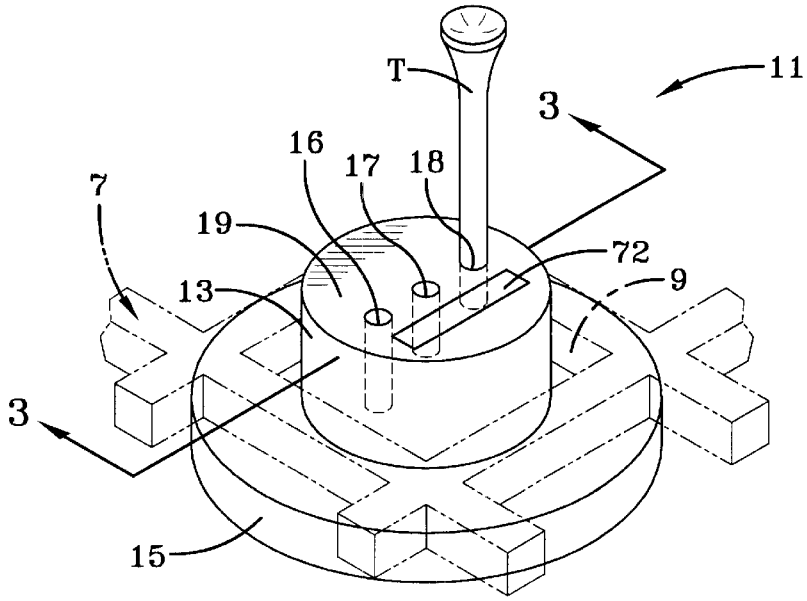
FIG. 2 is a perspective view of a preferred form of the invention.
Figure 3:
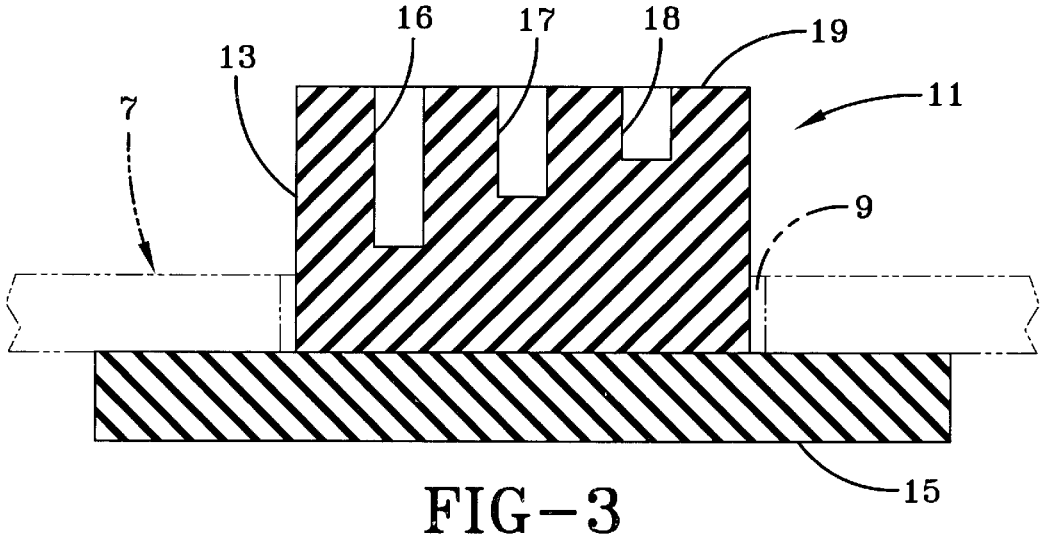
FIG. 3 is a cross sectional view of the device shown in FIG. 2, taken in the direction of 2—2.
Figure 3A:
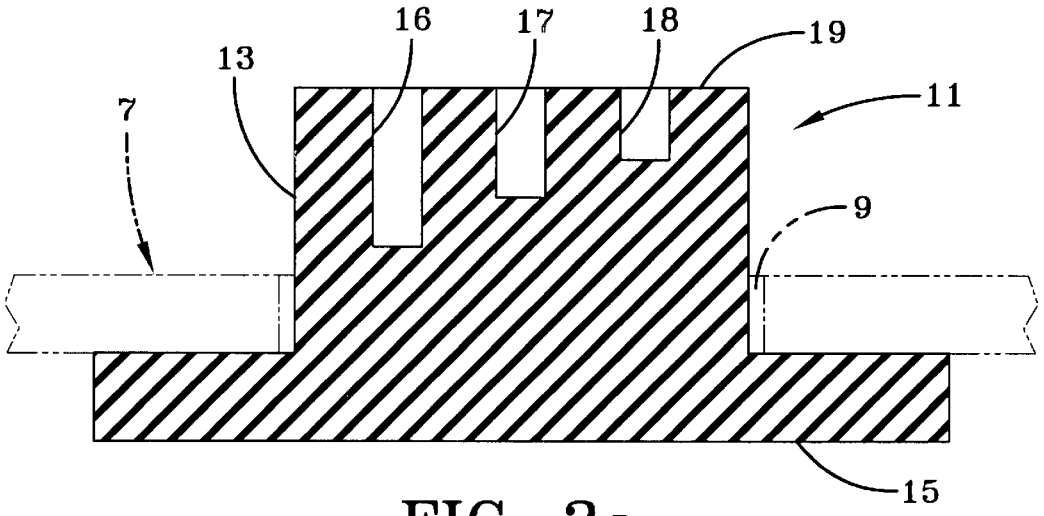
FIG. 3*a* is a cross sectional view of another embodiment of the device shown in FIG. 2, taken in the direction of 2—2.

A preferred form of the invention is shown in FIGS. 2 and 3. Referring to these figures, a golf teeing system 11 is shown. Golf teeing system 11 includes a body 13 made of rubber or rubber-like material which is supported by a base 15. Body 13 and base 15 can be an integral unit, i.e. having the same elements, (FIG. 3*a*) or they can be secured together by a means of adhesives, a mechanical attachment, a heat fusion of the materials of each component, or the like. Two, three (as shown) or any other number of cylindrical holes or bores 16–18 are provided in the upper surface 19 of body 13. Bores 16–18 could be molded in body 13 if body 13 is a molded product, it could be drilled into body 13, or provided in some other economical and convenient way. The diameter of cylinders 16–18 should be sufficient to receive and releasably hold the shank of a golf tee, shown as-member T sitting in bore 18. It can be seen that this bore 18 is relatively shallow, from which tee T would extend quite high above body 13, whereas it would extend to a lower height in bore 17, and at an even lower height in bore 16. The same mat 7 that is used in the prior art could be used with the present invention, and is shown accordingly. Body 13 extends through hole 9 in mat 7.

When a golfer wants to use golf tee system 11, the golfer selects whichever hole is desired and pushes a conventional tee into the hole. Since body 13 is made of a slightly elastomeric material, and since the diameter of the holes is sufficient to receive the stem of tee T in a tight but sliding arrangement, the friction between body 13 and tee T holds the tee in place. If the golfer decides to change a club for whatever reason, the golfer could simply put a different tee in a different hole, and continue playing with the golf balls set at the desired level.

A legend 72 can be placed near the bores in order to inform the golfer as to the depth of the respective bores. Legend 72 may be marked for the type of club one would ordinarily use, such as 1 for a driver, 2 for a wood, 3 for a 2 wood, 2*i* for a 2 iron, 3*i* for a 3 iron, etc. Any appropriate legend 72 may be employed. Likewise, different colors or other such symbols could be used as well.

Figure 4:
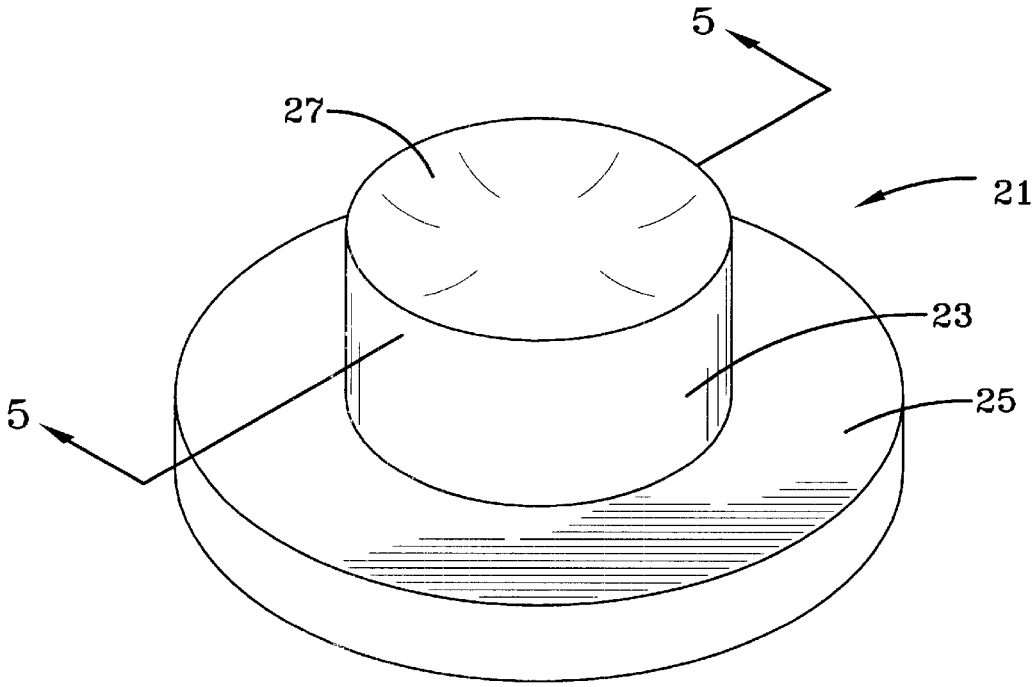
FIG. 4 is a perspective view of another embodiment of the invention.
Figure 5:
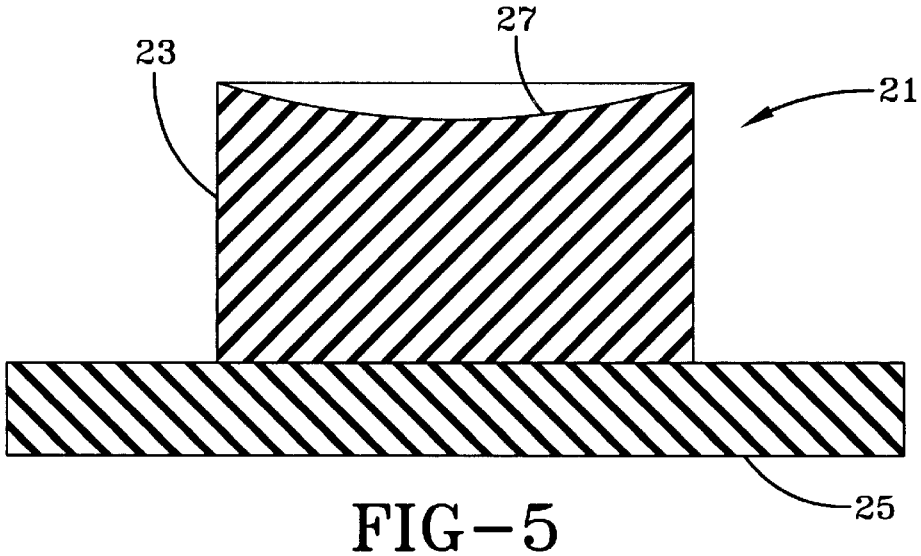
FIG. 5 is a cross section taken in the direction 4—4 shown in FIG. 4.

Another embodiment or an addition to the golf tee system shown in FIGS. 2 and 3 is shown in FIGS. 4 and 5. These figures show another golfing system 21, as shown. This includes a body 23 which sits on a base 25. Body 23 is made of a slightly elastomeric or even rigid material, which can be the same material from which base 25 is made. The height of body 23 above base 25 is somewhat less than the height of body 13 above base 15. Moreover, the upper surface 27 of body 23 is slightly dished or concave in order to hold a golf ball. System 21 is enlarged for clarity. A golfer can rest a golf ball in dished portion 27, and would typically hit the golf ball with an iron or perhaps a higher numbered wood which simulates hitting the golf ball off the ground. Please note that it barely extends above mat 7. Golf tee systems 21 can be used in addition to (i.e. as a supplement to) golf systems 11, shown in FIGS. 2 and 3.

Figure 6:
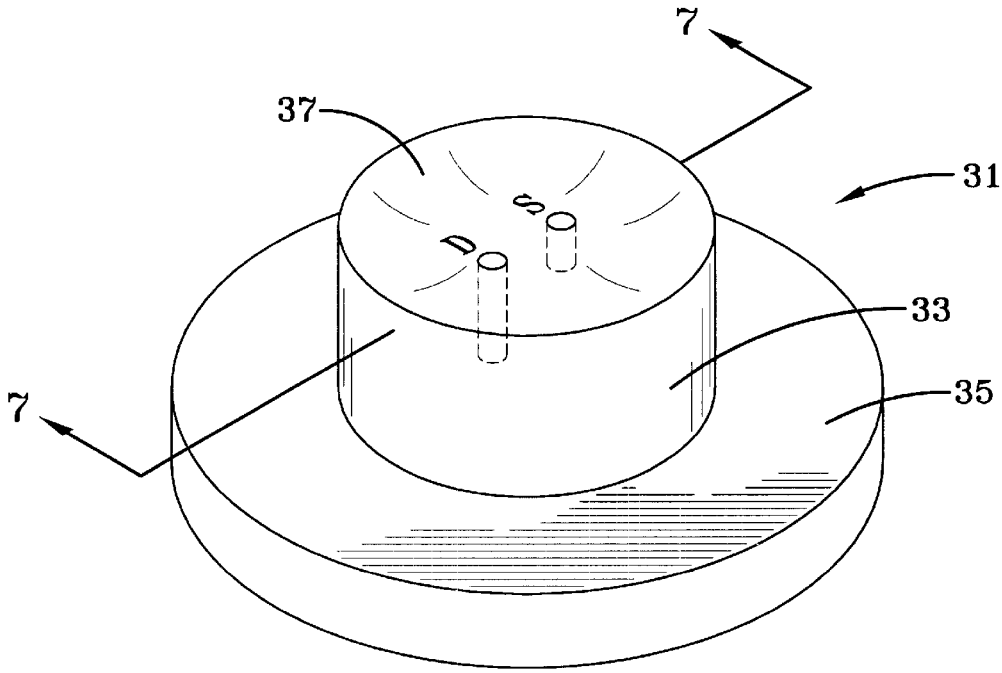
FIG. 6 is a perspective view of still another embodiment of the invention.
Figure 7:
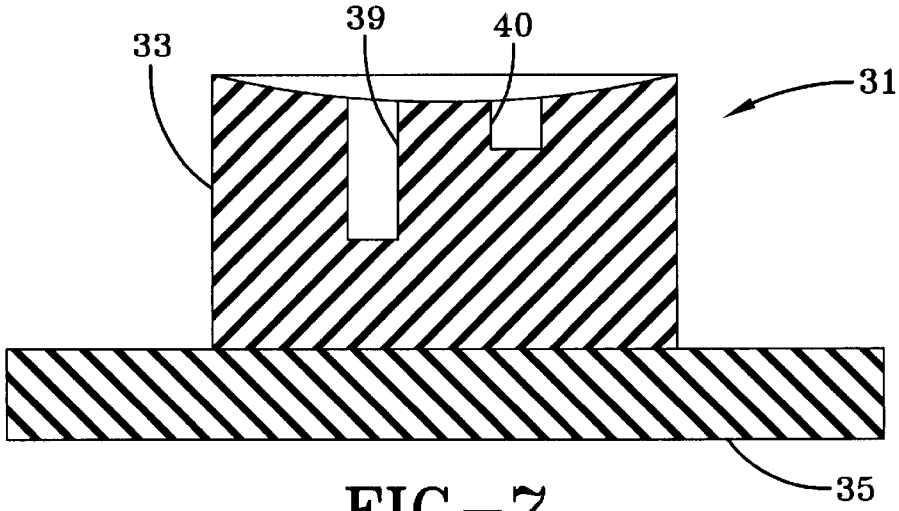
FIG. 7 is a cross sectional view taken in the direction 7—7 in FIG. 6.

Another variation is shown in FIGS. 6 and 7, where a golf tee is provided having both bores of various depths into the golf tee body so that a golf tee will extend above the body by different amounts according to the preference of the golfer and the club which the golfer is using, and the top of the body is dished and concave, so that the golfer cannot use a separate tee at all, but simply set the ball on the concave portion and hit the golf ball with a golf club.

Golf tee assembly 31 includes a body section 33 and a base section 35. Body section 33 has a dished, concave section 37 dimensioned to hold a golf ball for a golfer to hit with a golf club. The drawing is enlarged for the sake of clarity, since only a very small portion of the golf ball needs to be engaged by the dished portion in order to properly support the golf ball. Provided in body portion 37 are at least two bores 39 and 40 into which a golf tee can be inserted to hold the golf ball at different heights above body portion 33. As explained earlier, body portion 33 is somewhat elastomeric, so that it can frictionally hold a golf tee in place. The width of the bores should be small enough to hold different types of golf tees which are on the market, and not so large that the golf tee could not be held in a vertical position by body portion 33. Golf tee system 31 operates in the same manner as golf tee systems 21 and 31 discussed above.

A legend can be placed near the bores in each of the embodiments in order to inform the golfer as to the depth of the respective bores. In the embodiment shown in FIG. 6, the two bores are marked with the letters S, for shallow, and D, for deep. They could be marked for the type of club one would ordinarily use, such as 1 for a driver, 2 for a 2 wood, 3 for a 2 wood, 2*i* for a 2 iron, 3*i* for a 3 iron, etc. Any appropriate legend could be used. Likewise different colors or other such symbols could be used as well.

Figure 8:
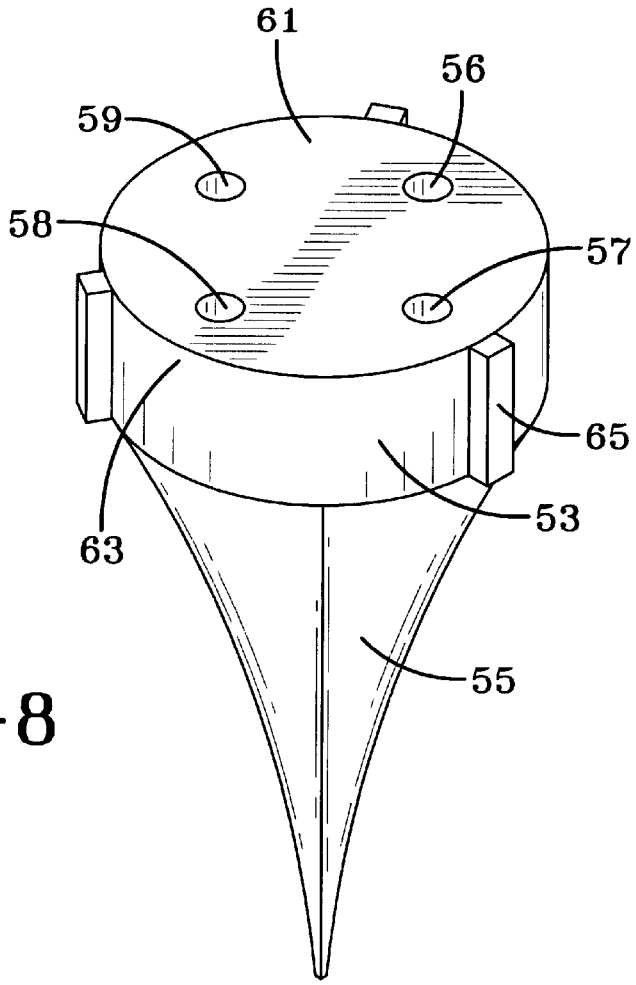
FIG. 8 is a perspective view of another embodiment of the invention.

Another embodiment of the invention is shown in FIG. 8. In this figure, a golf tee assembly 51 is shown. It includes a body section 53 and a spike 55 for insertion into the 30 ground. A set of bores 56–59 are provided in the upper surface 61, these bores being of various depths as described previously. Bores 56–59 can receive ordinary tees or insertion, to have them project above the ground at desired heights according to the determination of the golfer.

Golf tee assembly 51 is meant for use on grass surfaces or dirt, so that spike 55 can be driven into the ground either manually or with an appropriate tool. Assembly 51 would preferably be driven into the ground so that the ground level is near area 63, close to the upper surface 61. Protrusions 65 can be incorporated to add strength to the assembly.

If assembly 51 is to be used at a practice range, it can be left in the ground permanently, throughout the golf season, or for any length of time desired. Assembly 51 can be moved, although an appropriate tool may be required to withdraw it from the ground.

Golf tee assembly 51 can be made from hard rubber, galvanized metal, hard plastic or the like. The assembly 51 is advantageous in that it allows for easy tee insertion, even though the ground may be very hard.

Figure 9:
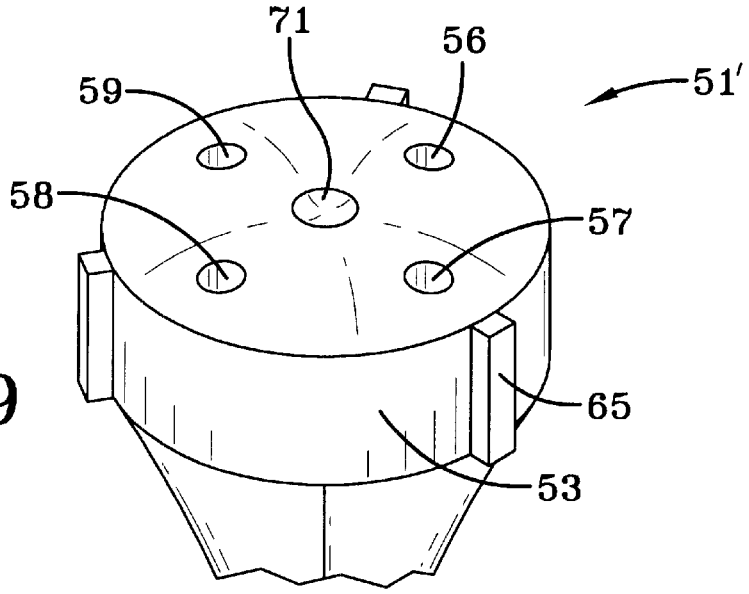
FIG. 9 is a partial perspective view of the embodiment shown in FIG. 8.

A variation is shown in FIG. 9, which is identical to FIG. 8, except that upper portion 61 of assembly 51 is convex with a depressed area 71 at its middle for holding a golf ball directly on the body. This can be used without a tee, such as irons.

Although any type of tees can be used with the embodiments described above, plastic tees may be somewhat desired since they are less likely to be severed, leaving their lower portion in the body of the system.

The invention has been described in detail with particular reference to the preferred embodiments thereof, but variations and modifications within the spirit and scope of the invention may occur to those skilled in the art to which the invention pertains.

What is claimed is:

1. A golf tee system comprising:

a body section, said body section having an upper, free portion and a lower portion, the upper portion having at least two bores extending into said body section to different depths for holding golf tees in the respective bores for extending above said upper, free portion by different amounts for holding a golf ball at different heights above said upper, free portion, wherein said body section is made from a slightly elastomeric material, and the walls of said bores are dimensioned to receive golf tees in a sliding arrangement and to frictionally grip the golf tees to hold them in place; and a base section for holding said upper free portion in place.

2. A golf tee system according to claim 1 further including a mat for a golfer to stand on to hit a golf ball from a tee received in one of said bores, said mat having an upper surface for a golfer to stand upon, lower surface for engaging the ground, and a hole for receiving said body section, the lower surface of said golf mat cooperating with said base section to hold body section in place, and said body section extending at least part way through said hole to present said bores for the golfer to selectively place a golf tee in a selected one of said bores.

3. A golf tee system according to claim 1 wherein a mat upon which a golfer stands for hitting a golf ball from a tee extending from one of said bores has a hole at least partly through which said body section extends, engages said base section to hold said body section in place.

* * * * *